US005368767A

United States Patent [19]

Donker et al.

[11] Patent Number: 5,368,767

[45] Date of Patent: Nov. 29, 1994

[54] STABLE NONAQUEOUS LIQUID DETERGENTS CONTAINING A METAL OXIDE OF BULK DENSITY OF 200-1,000 G/L

[75] Inventors: Cornelis B. Donker, Caldy, Great Britain; Philippus C. van der Hoeven, Prinsenbeek, Netherlands; Mansur S. Mohammadi, Spital, Great Britain

[73] Assignee: Unilever Patent Holdings, B.V., Vlaardingen, Netherlands

[21] Appl. No.: 916,841

[22] Filed: Oct. 16, 1992

[30] Foreign Application Priority Data

Feb. 16, 1990 [XH] Hague Agreement ..... 90200350.8

[51] Int. Cl.[5] ..... C11D 1/72; C11D 3/12; C11D 3/60; C11D 17/08

[52] U.S. Cl. ..... 252/95; 252/8.6; 252/8.8; 252/8.9; 252/99; 252/102; 252/104; 252/139; 252/140; 252/164; 252/171; 252/174.12; 252/174.14; 252/174.21; 252/174.22; 252/174.25; 252/309; 252/DIG. 1; 252/DIG. 14

[58] Field of Search ..... 252/140, 154, 163, 164, 252/165, 174.21, 174.25, DIG. 14, 95, 99, 102, 104, 174.12, 174.14, 174.22, 139, 171, 309

[56] References Cited

U.S. PATENT DOCUMENTS

| | | | |
|---|---|---|---|
| 3,630,929 | 12/1971 | Van Dijk | 252/136 |
| 3,981,826 | 9/1976 | Munro | 252/526 |
| 3,985,668 | 10/1976 | Hartman | 252/99 |
| 4,123,395 | 10/1978 | Maguire | 252/559 |
| 4,830,783 | 5/1989 | Ellis | 252/545 |
| 5,102,574 | 4/1992 | Russell | 252/174.21 |
| 5,147,576 | 9/1992 | Montague | 252/174 |
| 5,160,655 | 11/1992 | Donker | 252/95 |

FOREIGN PATENT DOCUMENTS

| | | |
|---|---|---|
| 63346 | 10/1982 | European Pat. Off. . |
| 81908 | 6/1983 | European Pat. Off. . |
| 266199 | 5/1988 | European Pat. Off. . |
| 2027349 | 9/1970 | France . |
| 2618157 | 1/1989 | France . |

*Primary Examiner*—Dennis Albrecht
*Attorney, Agent, or Firm*—Cushman, Darby & Cushman

[57] ABSTRACT

A non-aqueous liquid cleaning composition comprising a particulate solid phase suspended in a non-aqueous liquid phase, wherein the solid phase includes a metal oxide having a bulk density of 200 to 1,000 g/l.

9 Claims, No Drawings

STABLE NONAQUEOUS LIQUID DETERGENTS CONTAINING A METAL OXIDE OF BULK DENSITY OF 200-1,000 G/L

The present invention relates to liquid non-aqueous cleaning products, especially non-aqueous liquid detergent compositions containing particulate solid materials. Non-aqueous liquids are those containing little or no water.

In liquid detergents in general, especially those for the washing of fabrics, it is often desired to suspend particulate solids, which have beneficial auxiliary effects in the wash, for example detergency builders to counteract water hardness, as well as bleaches. To keep the solids in suspension and/or to prevent clear layer separation, generally some sort of stabilising system is necessary.

It has been proposed in GB 1 205 711 to incorporate highly voluminous metal and metalloid oxides in non-aqueous built liquid detergent compositions.

It has now been found that non-aqueous liquid detergent compositions with a reduced tendency to clear layer separation can be formulated by including therein a metal oxide having a bulk density of 200 to 1000 g/l. Another possible advantage of using these metal oxides is a reduction in setting.

Thus according to the invention there is provided a non-aqueous liquid cleaning composition comprising a particulate solid phase suspended in a non-aqueous liquid phase, wherein the solid phase includes a metal oxide having a bulk density of 200 to 1,000 g/l.

Preferably the metal oxide is selected from calcium oxide, magnesium oxide and aluminium oxide, most preferably magnesium oxide is used. The metal oxide preferably has a bulk density of 250 to 800 g/l, more preferably 300 to 700 g/l, most preferably from 400 to 650 g/l. The weight average particle size of the metal oxide is preferably from 0.1 to 200 micrometer, more preferably from 0.5 to 100 micrometer, most preferred from 2 to 70 micrometer. The level of metal oxide is preferably from 0.1 to 7% by weight of the composition, more preferred from 0.5 to 5%, most preferred from 1 to 4%.

PRODUCT FORM

All compositions according to the present invention are liquid cleaning products. In the context of this specification, all references to liquids refer to materials which are liquid at 25° C. at atmospheric pressure.

Preferably compositions of the invention have a viscosity of less than 2,500 mPa.s at 21 $S^{-1}$, more preferred 100–2,000 mPa.s.

They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialised cleaning products, such as for surgical apparatus or artificial dentures. They may also be formulated as agents for washing and/or conditioning of fabrics.

Thus, the compositions will contain at least one agent which promotes the cleaning and/or conditioning of the article(s) in question, selected according to the intended application. Usually, this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

SURFACTANT

Where surfactants are solids, they will usually be dissolved or dispersed in the liquid phase. Where they are liquids, they will usually constitute all or part of the liquid phase. However, in some cases the surfactants may undergo a phase change in the composition.

In general, surfactants for use in the compositions of the invention may be chosen from any of the classes, sub-classes and specific materials described in "Surface Active Agents" Vol. I, by Schwartz & Perry, Interscience 1949 and "Surface Active Agents" Vol. II by Schwartz, Perry & Berch (Interscience 1958), in the current edition of "McCutcheon's Emulsifiers & Detergents" published by the McCutcheon division of Manufacturing Confectioners Company or in "Tensid-Taschenbuch", H. Stache, 2nd Edn., Carl Hanser Verlag, München & Wien, 1981.

In respect of all surfactant materials, but also with reference to all ingredients described herein as examples of components in compositions according to the present invention, unless the context requires otherwise, the term "alkyl" refers to a straight or branched alkyl moiety having from 1 to 30 carbon atoms, whereas lower alkyl refers to a straight or branched alkyl moiety of from 1 to 4 carbon atoms. These definitions apply to alkyl species however incorporated (e.g. as part of an aralkyl species). Alkenyl (olefin) and alkynyl (acetylene) species are to be interpreted likewise (i.e. in terms of configuration and number of carbon atoms) as are equivalent alkylene, alkenylene and alkynylene linkages. For the avoidance of doubt, any reference to lower alkyl or $C_{1-4}$ alkyl (unless the context so forbids) is to be taken specifically as a recitation of each species wherein the alkyl group is (independent of any other alkyl group which may be present in the same molecule) methyl, ethyl, iso-propyl, n-propyl, n-butyl, iso-butyl and t-butyl, and lower (or $C_{1-4}$) alkylene is to be construed likewise.

NON-IONIC SURFACTANTS

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di- alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification EP-A-225,654, especially for use as all or part of the liquid phase. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the liquid phase.

Another class of suitable nonionics comprise the alkyl polysaccharides (polyglycosides/oligosaccharides) such as described in any of specifications U.S. Pat. No. 3,640,998; U.S. Pat. No. 3,346,558; U.S. Pat. No. 4,223,129; EP-A-92,355; EP-A-99,183; EP 70,074, '75, '76, '77; EP 75,994, '95, '96.

Mixtures of different nonionic detergent surfactants may also be used. Mixtures of nonionic detergent surfactants with other detergent surfactants such as anionic, cationic or ampholytic detergent surfactants and soaps may also be used.

Preferably the level of nonionic surfactants is from 10–90% by weight of the composition, more preferably 20–70%, most preferably 35–50% by weight.

ANIONIC SURFACTANTS

Examples of suitable anionic detergent surfactants are alkali metal, ammonium or alkylolamine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, and olefin sulphonates prepared by sulphonation of $C_{10-24}$ alpha-olefins and subsequent neutralization and hydrolysis of the sulphonation reaction product.

All ingredients before incorporation will either be liquid, in which case, in the composition they will constitute all or part of the liquid phase, or they will be solids, in which case, in the composition they will either be dispersed in the liquid phase or they will be dissolved therein. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

THE NON-AQUEOUS ORGANIC SOLVENT

As a general rule, the most suitable liquids to choose as the liquid phase are those organic materials having polar molecules. In particular, those comprising a relatively lipophilic part and a relatively hydrophilic part, especially a hydrophilic part rich in electron lone pairs, tend to be well suited. This is completely in accordance with the observation that liquid surfactants, especially polyalkoxylated nonionics, are one preferred class of material for the liquid phase.

Non-surfactants which are suitable for use as the liquid phase include those having the preferred molecular forms referred to above although other kinds may be used, especially if combined with those of the former, more preferred types. In general, the non-surfactant solvents can be used alone or with in combination with liquid surfactants. Non-surfactant solvents which have molecular structures which fall into the former, more preferred category include ethers, polyethers, alkylamines and fatty amines, (especially di- and tri-alkyl- and/or fatty-N-substituted amines), alkyl (or fatty) amides and mono- and di- N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Many light solvents with little or no hydrophilic character are in most systems, unsuitable on their own Examples of these are lower alcohols, such as ethanol, or higher alcohols, such as dodecanol, as well as alkanes and olefins. However, they can be combined with other liquid materials.

LEVEL OF LIQUID PHASE

Preferably, the compositions of the invention contain the liquid phase (whether or not comprising liquid surfactant) in an amount of at least 10% by weight of the total composition. The amount of the liquid phase present in the composition may be as high as about 90%, but in most cases the practical amount will lie between 20 and 70% and preferably between 35 and 50% by weight of the composition.

SOLIDS CONTENT

In general, the solids content of the product may be within a very wide range, for example from 10–90%, usually from 30–80% and preferably from 50–65% by weight of the final composition. The solid phase is preferably in particulate form and preferably has a weight average particle size of less than 300 microns, preferably less than 200 microns, more preferably less than 100 microns, especially less than 10 microns. The particle size may even be of sub-micron size. The proper particle size can be obtained by using materials of the appropriate size or by milling the total product in a suitable milling apparatus. In order to control aggregation of the solid phase leading to unredispersible settling or setting of the composition, it is preferred to include a deflocculant therein.

OTHER INGREDIENTS

In addition to the components already discussed, there are very many other ingredients which can be incorporated in liquid cleaning products.

There is a very great range of such other ingredients and these will be choosen according to the intended use of the product. However, the greatest diversity is found in products for fabrics washing and/or conditioning. Many ingredients intended for that purpose will also find application in products for other applications (e.g. in hard surface cleaners and warewashing liquids).

HYDROPHOBICALLY MODIFIED MATERIALS

Surprisingly, it has also been found that the physical stability of non-aqueous liquid detergent compositions can be even further improved and/or setting problems can be minimised, if hydrophobically modified dispersants are used in combination with the metal oxides as described above.

For the purpose of the present invention, a dispersant material is a material, of which the main purpose is to stabilise the composition. Hydrophobically modified dispersant materials are particulate materials, of which the outer surface has chemically been treated to reduce the hydrophilic nature thereof.

Preferred HM materials have a weight average particle size of from 0,005 to 5 micrometer, more preferred 0.01 to 3 micrometer, most preferred from 0.02 to 0.5 micrometer. The level of the HM material is preferably from 0.1 to 10% by weight of the composition, more preferred 0.3 to 5%, most preferred from 0.5 to 3%.

Preferably the number of hydroxy- and/or acid-groups at the surface of the particles is reduced by the hydrophobing treatment. Suitable reactions include esterification or etherfication of the hydrophilic groups. Preferably the hydrophobing treatment involves at least 10% of the hydrophilic groups at the surface of the particle, more preferably from 40 to 95%, most preferably from 50 to 90%. Partial hydrophobing is preferred over complete hydrophobation.

Preferably HM silica containing dispersants are used. The hydrophobation of the silica particles preferably involves the substitution of the free hydroxy-groups at the outer surface of the silica particles by a short alkyl group. More preferably the surface hydroxy-groups are substituted by methyl groups.

DETERGENCY BUILDERS

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aluminosilicates-type materials, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates.

Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Examples of organic builders include the alkali metal, ammonium and substituted ammonium, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers and their salts, such as those sold by BASF under the Sokalan Trade Mark.

Preferably the level of builder materials is from 0–75% by weight of the composition, more preferred 5–50%, most preferred 10–40%.

THE DEFLOCCULANT

Preferably compositions of the invention also comprise a deflocculant material. In principle, any material may be used as a deflocculant provided it fulfills the deflocculation test described in European Patent Specification EP-A-266199 (Unilever). The capability of a substance to act as a deflocculant will partly depend on the solids/liquid phase combination. However, especially preferred are acids. Some typical examples of deflocculants include the alkanoic acids such as acetic, propionic and stearic and their halogenated counterparts such as trichloracetic and trifluoracetic as well as the alkyl (e.g. methane) sulphonic acids and aralkyl (e.g. paratoluene) sulphonic acids.

Examples of suitable inorganic mineral acids and their salts are hydrochloric, carbonic, sulphurous, sulphuric and phosphoric acids; potassium monohydrogen sulphate, sodium monohydrogen sulphate, potassium monohydrogen phosphate, potassium dihydrogen phosphate, sodium monohydrogen phosphate, potassium dihydrogen pyrophosphate, tetrasodium monohydrogen triphosphate.

Other organic acids may also be used as deflocculants, for example formic, lactic, amino acetic, benzoic, salicylic, phthalic, nicotinic, ascorbic, ethylenediamine tetraacetic, and aminophosphonic acids, as well as longer chain fatty carboxylates and triglycerides, such as oleic, stearic, lauric acid and the like. Peracids such as percarboxylic and persulphonic acids may also be used.

The class of acid deflocculants further extends to the Lewis acids, including the anhydrides of inorganic and organic acids. Examples of these are acetic anhydride, maleic anhydride, phthalic anhydride and succinic anhydride, sulphur-trioxide, diphosphorous pentoxide, boron trifluoride, antimony pentachloride.

"Fatty" anions are very suitable deflocculants, and a particularly preferred class of deflocculants comprises anionic surfactants. Although anionics which are salts of alkali or other metals may be used, particularly preferred are the free acid forms of these surfactants (wherein the metal cation is replaced by an $H^+$ cation, i.e. proton). These artionic surfactants include all those classes, sub-classes and specific forms described in the aforementioned general references on surfactants, viz, Schwartz & Perry, Schwartz Perry and Berch, McCutcheon's, Tensid-Taschenbuch; and the free acid forms thereof. Many anionic surfactants have already been described hereinbefore. In the role of deflocculants, the free acid forms of these are generally preferred.

In particular, some preferred sub-classes and examples are the $C_{10}$–$C_{22}$ fatty acids and dimers thereof, the $C_8$–$C_{18}$ alkylbenzene sulphonic acids, the $C_{10}$–$C_{18}$ alkyl- or alkylether sulphuric acid monoesters, the $C_{12}$–$C_{18}$ paraffin sulphonic acids, the fatty acid sulphonic acids, the benzene-, toluene-, xylene- and cumene sulphonic acids and so on. Particularly are the linear $C_{12}$–$C_{18}$ alkylbenzene sulphonic acids. As well as anionic surfactants, zwitterionic-types can also be used as deflocculants. These may be any described in the aforementioned general surfactant references. One example is lecithin.

The level of the deflocculant material in the composition can be optimised by the means described in the aforementioned EP-A-266199, but in very many cases is at least 0.01%, usually 0.1% and preferably at least 1% by weight, and may be as high as 15% by weight. For most practical purposes, the amount ranges from 2–12%, preferably from 4–10% by weight, based on the final composition.

THE BLEACH SYSTEM

Bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with a bleach precursor, or as a peroxy acid compound.

In the case of the inorganic persalt bleaches, the activator makes the bleaching more effective at lower temperatures, i.e. in the range from ambient temperature to about 60° C., so that such bleach systems are commonly known as low-temperature bleach systems and are well-known in the art. The inorganic persalt such as sodium perborate, both the monohydrate and the tetrahydrate, acts to release active oxygen in solution, and the activator is usually an organic compound having one or more reactive acyl residues, which cause the formation of peracids, the latter providing for a more effective bleaching action at lower temperatures than the peroxybleach compound alone.

The ratio by weight of the peroxybleach compound to the activator is preferably from about 20:1 to about 1:1, preferably from about 10:1 to about 2:1., most preferably 5:1 to 3.5:1. Whilst the amount of the bleach system, i.e. peroxybleach compound and activator, may be varied between about 5% and about 35% by weight of the total liquid, it is preferred to use from about 6% to about 30% of the ingredients forming the bleach system. Thus, the preferred level of the peroxybleach compound in the composition is between about 5.5% and about 27% by weight, while the preferred level of the activator is between about 0.5% and about 14%, most preferably between about 1% and about 5% by weight.

Typical examples of the suitable peroxybleach compounds are alkalimetal perborates, both tetrahydrates and monohydrates, alkali metal percarbonates, persilicates and perphosphates, of which sodium perborate and sodium percarbonate are preferred.

It is particularly preferred to include in the compositions, a stabilizer for the bleach or bleach system, for example ethylene diamine tetramethylene phosphonate and diethylene triamine pentamethylene phosphonate or other appropriate organic phosphonate or salt thereof, such as the Dequest range hereinbefore described. These stabilisers can be used in acid or salt form, such as the calcium, magnesium, zinc or aluminium salt form. The stabilizer may be present at a level of up to about 1% by weight, preferably between about 0.1% and about 0.5% by weight. Preferred activator materials are TAED and glycerol triacetate.

The applicants have also found that liquid bleach activator, such as glycerol triacetate and ethylidene heptanoate acetate, isopropenyl acetate and the like, also function suitably as a material for the liquid phase, thus obviating or reducing any need of additional relatively volatile solvents, such as the lower alkanols, paraffins, glycols and glycolethers and the like, e.g. for viscosity control.

MISCELLANEOUS OTHER INGREDIENTS

Other ingredients comprise those remaining ingredients which may be used in liquid cleaning products, such as fabric conditioning agents, enzymes, perfumes (including deoperfumes), micro-biocides, colouring agents, fluorescers, soil-suspending agents (anti-redeposition agents), corrosion inhibitors, enzyme stabilising agents, and lather depressants.

Amongst the fabric conditioning agents which may be used, either in fabric washing liquids or in rinse conditioners, are fabric softening materials such as fabric softening clays, quaternary ammonium salts, imidazolinium salts, fatty amines and cellulases.

Enzymes which can be used in liquids according to the present invention include proteolytic enzymes, amylolytic enzymes and lipolytic enzymes (lipases). Various types of proteolytic enzymes and amylolytic enzymes are known in the art and are commercially available. They may be incorporated as "prills", "marumes" or suspensions e.g.

The fluorescent agents which can be used in the liquid cleaning products according to the invention are well known and many such fluorescent agents are available commercially. Usually, these fluorescent agents are supplied and used in the form of their alkali metal salts, for example, the sodium salts. The total amount of the fluorescent agent or agents used in a detergent composition is generally from 0.02–2% by weight.

When it is desired to include anti-redeposition agents in the liquid cleaning products, the amount thereof is normally from about 0.1% to about 5% by weight, preferably from about 0.2% to about 2.5% by weight of the total liquid composition. Preferred anti-redeposition agents include carboxy derivatives of sugars and celluloses, e.g. sodium carboxymethyl cellulose, anionic poly-electrolytes, especially polymeric aliphatic carboxylates, or organic phosphonates.

WATER LEVEL

The compositions are substantially non-aqueous, i.e. they contain little or no free water, preferably no more than 5%, preferably less than 3%, especially less than 1% by weight of the total composition. It has been found that the higher the water content, the more likely it is for the viscosity to be too high, or even for setting to occur.

USE

Composition in accordance with the present invention may be used for several detergency purposes, for example the cleaning of surfaces and the washing of fabrics. For the washing of fabrics, preferably an aqueous liquor containing 0.1 to 10%, more preferably 0.2 to 2%, of the non-aqueous detergent composition of the invention is used.

PROCESSING

During manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the liquid phase in a dry vessel.

If deflocculant materials are used, these should preferably—at least partly—be mixed with the liquid phase, prior to the addition of the solids. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of de-aeration. Suitable equipment for cooling (e.g. heat exchangers) and de-aeration will be known to those skilled in the art.

It follows that all equipment used in this process should preferably be completely dry, special care being taken after any cleaning operations. The same is true for subsequent storage and packing equipment.

EXAMPLES 1–12

The following compositions (percent by weight) were prepared by mixing the ingredients in the order stated. It will be noted that the total solid phase level remains the same in all examples. The ingredients were milled after mixing to give a mean particle size of 5 μm. The tendency for the compositions to give clear layer separation was determined by filling a 100 mm tall measuring cylinder with the compositions, leaving it to stand without agitation for 4 weeks at 37° C. or 8 weeks at 20° C. and then noting the height of any visibly distinct upper layer. The initial viscosity of each composition is also given.

TABLE 1

| | EXAMPLE NO: | | | | | | | | | | | |
|---|---|---|---|---|---|---|---|---|---|---|---|---|
| | 1** | 2 | 3 | 4 | 5 | 6 | 7** | 8 | 9 | 10 | 11 | 12 |
| Nonionic[1] | 36.3 | 35.3 | 35.5 | 35.5 | 35.5 | 35.5 | 33.7 | 32.7 | 32.7 | 32.7 | 32.7 | 32.7 |
| Glyceroltriacetate | 15.7 | 15.4 | 15.4 | 15.4 | 15.4 | 15.4 | 14.3 | 14.2 | 14.2 | 14.2 | 14.2 | 14.2 |
| ABSA[2] | 2 | 2 | 2 | 2 | 2 | 2 | 6 | 6 | 6 | 6 | 6 | 6 |
| Na carbonate | 24 | 24 | 23 | 22 | 21 | 20 | 24 | 24 | 23 | 22 | 21 | 20 |
| Na perborate monohyd. | 11 | 11 | 11 | 11 | 11 | 11 | 11 | 11 | 11 | 11 | 11 | 11 |
| TAED | 3 | 3 | 3 | 3 | 3 | 3 | 3 | 3 | 3 | 3 | 3 | 3 |
| Calcite[3] | 8 | 8 | 8 | 8 | 8 | 8 | 8 | 8 | 8 | 8 | 8 | 8 |
| Mg oxide | 0 | 1 | 2 | 3 | 4 | 5 | 0 | 1 | 2 | 3 | 4 | 5 |
| Clear layer sep. (mm) | | | | | | | | | | | | |
| 8 weeks 20° C. | 10 | 8 | 10 | 9 | 6 | 5 | 7 | 7 | 5 | 5 | 4 | 3 |
| 4 weeks 37° C. | 11 | 8 | 10 | 9 | 8 | 5 | 7 | 4 | 4 | 3 | 3 | 2 |

Notes:
1 - A $C_{11}$ alcohol ethoxylated with an average of 6.5 ethylene oxide groups per molecule.
2 - The acid form of $C_{12}$ alkyl benzene sulphonic acid
3 - Socal U3 (Solvay)
4 - MgO-170 having a bulk density of about 560 g/l, particle size 2–25 μm
** - Comparative example These results show that the addition of magnesium oxide to these compositions shows an improvement in resistance to clear layer separation.

We find similar results if the magnesium oxide is added directly after the ABSA.

EXAMPLES 13–15

In a similar manner to Examples 1 to 12, the following compositions (percent by weight) were prepared and tested.

TABLE 2

| | EXAMPLE NO: | | |
|---|---|---|---|
| | 13** | 14 | 15 |
| Nonionic[5] | 39.6 | 39.6 | 39.6 |
| Glyceroltriacetate | 5 | 5 | 5 |
| ABSA | 8 | 8 | 8 |
| Na carbonate | 18 | 18 | 18 |
| Na bicarbonate | 3.2 | 2.2 | 1.2 |
| Calcite | 8 | 8 | 8 |
| Na perborate monohydrate | 10.5 | 10.5 | 10.5 |
| TAED | 3 | 3 | 3 |
| Mg oxide | 0 | 1 | 2 |
| Minor ingredients (polymers, enzymes, perfume, silicones) | | balance | |
| Clear layer separation (mm) | | | |
| 8 weeks 20° C. | 4 | 2 | 1 |
| 4 weeks 37° C. | 10 | 7 | 5 |

Notes:
5 - A $C_{10/12}$ alcohol ethoxylated with an average of 6.5 ethylene oxide groups per molecule.

These results show that even in the presence of usual minor ingredients (polymer, enzymes, perfume and silicones) the benefits of magnesium oxide are retained.

EXAMPLES 16 TO 18

In a similar manner, the following compositions (percent by weight) using calcium oxide in place of magnesium oxide were prepared and tested.

TABLE 3

| | EXAMPLE NO: | | |
|---|---|---|---|
| | 16 | 17 | 18 |
| Nonionic[5)] | 33.7 | 33.2 | 32.7 |
| Glyceroltriacetate | 14.3 | 14.3 | 14.3 |
| ABSA | 6 | 6 | 6 |
| Na carbonate | 24 | 24 | 24 |
| Na perborate monohydrate | 11 | 11 | 11 |
| TAED | 3 | 3 | 3 |

TABLE 3-continued

| | EXAMPLE NO: | | |
|---|---|---|---|
| | 16 | 17 | 18 |
| Calcite | 8 | 8 | 8 |
| Ca oxide[6)] | 0 | 0.5 | 1.0 |
| Clear layer separation (mm) | | | |
| 8 weeks 20° C. | 7 | 6 | 2 |
| 4 weeks 37° C. | 7 | 4 | 3 |

Notes:
5) - *As Examples 1 to 12.*
6) - *Bulk density 900 g/l*

These results show that calcium oxide produces a similar effect.

EXAMPLE 17

The following formulations were prepared as in Example I.

| Ingredient (% wt) | E | F |
|---|---|---|
| Nonionic[1)] | 31.996 | |
| Nonionic[2)] | | 42.9 |
| GTA | 15.0 | 6.1 |
| ABS-acid | 6.0 | 3.4 |
| Na carbonate | 18.0 | 15.8 |
| Calcite (Sokal U3) | 7.0 | 7.6 |
| MgO[3)] | 1.0 | 1.7 |
| Silica (Sipernat D17) | 2.0 | 3.4 |
| Perborate mono | 10.5 | 11.0 |
| TAED | 3.0 | 3.4 |
| SCMC | 1.0 | — |
| Fluorescer | 0.3 | — |
| Versa TL3 polymer | 0.5 | — |
| Methylhydroxyethyl cellulose | 0.5 | — |
| Silicones | 2.0 | 2.0 |
| Protease | 0.4 | 0.4 |
| Lipolase | 0.3 | 0.3 |
| Perfume | 0.5 | 0.5 |
| Colour | 0.004 | 0.1 |

[1)]NRE nonionic material ex Vista
[2)]$C_{10-12}$ 6.5 EO
[3)]MgO-170 having a bulk density of about 560 g/l, particle size 2–25 μm.

Both compositions were of surprisingly good stability and did show no or only little phase separation upon storage.

EXAMPLE 18

The following composition was made as in Example I.

| | |
|---|---|
| Nonionic[1)] | 20.0 |
| Nonionic[2)] | 20.0 |
| ABS-acid | 3.1 |
| MgO[4)] | 0.2 |
| Sodiummetasilicate | 45.7 |
| Sokalan CP7 | 5.1 |
| CaO[3)] | 1.0 |
| Minors (fluorescer, polyacrylate, antifoam, etc.) | balance |

The initial viscosity of the composition was 1728 mPa.s at 21 $S^{-1}$.

The clear layer separation was measured as in Example I,

| Time | 37° C. (in mm) | 20°C. (in mm) |
|---|---|---|
| 1 day | 0 | 0 |
| 1 week | 2 | 0 |
| 2 weeks | 3 | 2 |
| 3 weeks | 5 | 2 |
| 4 weeks | 7 | 4 |

notes:
[1)]Imbetin
[2)]Synperonic A3
[3)]Bulk density 900 g/l
[4)]As in Example I

EXAMPLE 19

The following composition was prepared by mixing the ingredients in the order listed.

| Ingredient | pts by weight |
|---|---|
| Nonionic[1)] | 28.1 |
| Nonionic[2)] | 14.0 |
| GTA | 9.0 |
| Lactic acid | 2.0 |
| Na carbonate (anhydrous) | 18.0 |
| Na perborate mono | 15.0 |
| Calcite | 7.0 |
| Mgo[3)] | 1.0 |

[1)]NRE nonionic material ex Vista
[2)]Synperonic A3
[3)]MgO as in example I, 50% of which was treated by repeated washing with water, filtering and drying.

The product was initially fluid, but setted upon storage. The clear layer separation upon storage was 2% (up to 7 days) or 0% (up to 90 days) at ambient temperature.

I claim:

1. A non-aqueous liquid cleaning composition comprising from 10 to 65% by weight of a particulate solid phase selected from surfactant builder, bleach, abrasive, fabric softening material and mixtures thereof, suspended in from 10 to 90% by weight of a non-aqueous liquid phase comprising from 20 to 70% by weight of the composition of nonionic surfactants, wherein the solid phase further includes from 0.1 to 7% by weight of a metal oxide having a bulk density of 250–1,000 g/l; wherein said metal oxide has a particle size of 0.1–70 μm, said solid phase has a weight average particle size of less than 300 microns and said composition has a viscosity of less than 2,500 mPa.s at 21 $S^{-1}$.

2. The composition according to claim 1, further comprising from 0.01 to 15% by weight of a deflocculant material selected from alkanoic acids, alkyl sulfonic acids, aralkyl sulphonic acids, inorganic mineral acids and their salts, peracids, Lewis acids, anionic surfactants, zwitterionic surfactants and mixtures thereof.

3. The composition according to claim 2, wherein said deflocculant material is selected from the group consisting of anionic surfactants in acid form and lactic acid.

4. Composition according to claim 3, wherein the metal oxide is selected from calcium oxide, magnesium oxide and aluminium oxide.

5. The composition according to claim 1, comprising 0–75% of builder materials, 5.5 to 27% of a peroxygen bleach, and 0.5 to 14% of a bleach activator.

6. A non-aqueous liquid cleaning composition comprising from 10 to 65% by weight of a particulate solid phase selected from surfactant builder, bleach, abrasive, fabric softening material and mixtures thereof, suspended in from 10 to 90% by weight of a non-aqueous liquid phase comprising from 20 to 70% by weight of the composition of nonionic surfactants, wherein the solid phase further includes from 0.1 to 7% by weight of a metal oxide selected from the group consisting of magnesium oxide and calcium oxide having a bulk density of 250–1,000 g/l; wherein said metal oxide has a particle size of 0.1–70 μm, said solid phase has a weight average particle size of less than 100 microns and said composition has a viscosity of less than 2,500 mPa.s at 21 $S^{-1}$.

7. The composition according to claim 6, further comprising from 0.01 to 15% by weight of a deflocculant material selected from alkanoic acids, alkyl sulfonic acids, aralkyl sulphonic acids, inorganic mineral acids and their salts, peracids, Lewis acids, anionic surfactants, zwitterionic surfacts and mixtures thereof.

8. The composition according to claim 7, wherein said deflocculant material is selected from the group consisting of anionic surfactants in acid form and lactic acid.

9. The composition according to claim 6, comprising 0–75% of builder materials, 5.5 to 27% of a peroxygen bleach, and 0.5 to 14% of a bleach activator.

* * * * *